US012747523B2

(12) United States Patent
Kaki et al.

(10) Patent No.: US 12,747,523 B2
(45) Date of Patent: Sep. 29, 2026

(54) TOWEL WOVEN FABRIC

(71) Applicant: Twin Co., Ltd., Imabari Ehime (JP)

(72) Inventors: Takaya Kaki, Imabari (JP); Tadayuki Okuda, Nishitokyo (JP)

(73) Assignee: Twin Co., Ltd., Imabari Ehime (JP)

( * ) Notice: Subject to any disclaimer, the term of this patent is extended or adjusted under 35 U.S.C. 154(b) by 0 days.

(21) Appl. No.: 19/405,428

(22) Filed: Dec. 2, 2025

(65) Prior Publication Data

US 2026/0085454 A1 Mar. 26, 2026

Related U.S. Application Data

(63) Continuation-in-part of application No. PCT/JP2024/015048, filed on Apr. 15, 2024.

(30) Foreign Application Priority Data

Jun. 14, 2023 (JP) ..... 2023-097390

(51) Int. Cl.
*D03D 15/47* (2021.01)
*D03D 15/217* (2021.01)
(Continued)

(52) U.S. Cl.
CPC ..... *D03D 15/47* (2021.01); *D03D 15/217* (2021.01); *D03D 15/225* (2021.01); *D03D 27/08* (2013.01);
(Continued)

(58) Field of Classification Search
CPC .... D03D 15/47; D03D 15/217; D03D 15/225; D03D 27/08; D03D 1/0017; D03D 1/00;
(Continued)

(56) References Cited

U.S. PATENT DOCUMENTS 2,655,950 A * 10/1953 Mills ..... D03D 27/08 139/396
9,770,931 B2 * 9/2017 Zhou ..... D06M 13/288
(Continued)

FOREIGN PATENT DOCUMENTS

CN 2252820 Y * 4/1997
CN 105506835 A * 4/2016 ..... D03D 27/08
(Continued)

OTHER PUBLICATIONS

Tierney, John William, "Kinetics of Cellulose Dissolution in N-Methyl Morpholine-N-Oxide and Evaporative Processes of Similar Solutions." Master's Thesis, University of Tennessee, Dec. 2005. https://trace.tennessee.edu/utk_gradthes/2553.

*Primary Examiner* — Robert H Muromoto, Jr.
(74) *Attorney, Agent, or Firm* — JTT Patent Services, LLC; Gerald T. Peters

(57) ABSTRACT

A towel product includes a gauze layer and a pile layer. The gauze layer includes multiple-wound yarns serving as warp yarn and weft yarn, the multiple-wound yarns each including cotton yarn and regenerated cellulose yarn manufactured without causing substitution of hydroxy groups that are twisted together. The pile layer includes pile disposed on at least an exterior surface. The pile layer woven from cotton yarn. The gauze layer and the pile layer coupled such that entanglement of gauze layer warp yarn and pile layer ground weft yarn occurs with a prescribed period. Cotton yarn of multiple-wound yarn single-ply yarn. Regenerated cellulose yarn of multiple-wound yarn two-ply yarn. Multiple-wound yarn contains cotton yarn in an amount that is 30 mass % to 70 mass %, and contains regenerated cellulose yarn in an amount that is 70 mass % to 30 mass %.

11 Claims, 2 Drawing Sheets

(51) Int. Cl.

| | |
|---|---|
| ***D03D 15/225*** | (2021.01) |
| ***D03D 27/08*** | (2006.01) |
| ***D06P 3/82*** | (2006.01) |
| *D03D 11/00* | (2006.01) |

(52) U.S. Cl.
CPC ..... *D06P 3/828* (2013.01); *D10B 2201/02* (2013.01); *D10B 2201/22* (2013.01); *D10B 2503/00* (2013.01)

(58) Field of Classification Search
CPC ..... D03D 15/44; D03D 27/00; D06P 3/828; D10B 2201/02; D10B 2201/22; D10B 2503/00; D02G 3/04
See application file for complete search history.

(56) References Cited

U.S. PATENT DOCUMENTS

| | | | | |
|---|---|---|---|---|
| 10,196,763 | B2 * | 2/2019 | Debnath | D02G 3/04 |
| 10,968,544 | B2 * | 4/2021 | Debnath | D03D 27/08 |
| 11,624,133 | B2 * | 4/2023 | Pacheriwala | D03D 13/008 442/199 |
| 11,702,774 | B2 * | 7/2023 | Goenka | D02G 3/28 139/396 |
| 11,926,936 | B2 * | 3/2024 | Lawrence | D02G 3/36 |
| 12,344,969 | B2 * | 7/2025 | Lawrence | D02G 3/36 |
| 12,644,207 | B2 * | 6/2026 | Bhatnagar | D02G 3/04 |
| 2018/0103783 | A1 * | 4/2018 | Danaher | A47G 9/0238 |
| 2020/0056309 | A1 * | 2/2020 | Gupta | D03D 15/283 |
| 2025/0263870 | A1 * | 8/2025 | Danaher | A47G 9/0238 |

FOREIGN PATENT DOCUMENTS

| | | | | |
|---|---|---|---|---|
| CN | 111118705 | A * | 5/2020 | D03D 15/54 |
| CN | 114411300 | A * | 4/2022 | D03D 27/08 |
| JP | 2002105797 | A * | 4/2002 | |
| JP | 2005-163251 | A | 6/2005 | |
| JP | 4538944 | B2 * | 9/2010 | |
| JP | 3205134 | U | 7/2016 | |

* cited by examiner

TOWEL WOVEN FABRIC

CROSS-REFERENCE TO RELATED APPLICATION(S), BENEFIT/PRIORITY CLAIM(S), AND INCORPORATION(S) BY REFERENCE

This application is a continuation-in-part of and claims benefit under 35 USC 120 and 365(c) to copending International Application No PCT/JP2024/015048, entitled "Towel Woven Fabric", filed 15 Apr. 2024; and further claims benefit of priority under 35 USC 119(a)-(d) to Japanese Patent Application No 2023-097390, entitled "Towel Woven Fabric", filed 14 Jun. 2023, the contents of all of which applications, as well as the monograph entitled "Kinetics of Cellulose Dissolution in N-Methyl Morpholine-N-Oxide and Evaporative Processes of Similar Solutions" by John William Tierney (Master's Thesis, University of Tennessee, 2005; https://trace.tennessee.edu/utk_gradthes/2553), are incorporated herein in their entireties by reference.

STATEMENT REGARDING PRIOR DISCLOSURE(S) BY INVENTOR(S) UNDER 37 CFR 1.77(b)(6)

The following patent(s) and published patent application(s) are disclosures by, originating with, and/or attributable to at least one of the inventors of the present application:

WO 2024 257471 A1 ("Towel Woven Fabric"; 19 Dec. 2024); and

JP 2024 178964 A ("Towel Woven Fabric"; 26 Dec. 2024).

FIELD OF THE INVENTION

The present invention relates to a towel woven fabric suitable for printing of pictorial content.

BACKGROUND

Printing of pictorial content on towels in accordance with one embodiment of the present invention especially suited for printing with high resolution on pile surfaces may be achieved by causing one face of the towel to be a gauze surface or a shirred surface that has been subjected to shirring.

For example, one face of a towel woven fabric in such an embodiment might be a gauze surface, or one face of a towel woven fabric in another such embodiment might be a shirred surface.

In some embodiments, cotton yarn is used as the yarn which makes up the towel woven fabric. But because coloration may be poor when using a dye-based ink to carry out printing on woven fabric comprising cotton yarn, there are cases in which desired color reproducibility cannot be attained. Conversely, where a yarn better suited to printing with dye-based ink is used instead of cotton yarn, this may cause the flexibility and/or feel against the skin of the towel woven fabric to be greatly reduced.

There is therefore a need for a towel woven fabric permitting satisfactory printing without adversely affecting the flexibility, satisfactory feel against the skin, and so forth thereof.

SUMMARY OF INVENTION

A towel woven fabric associated with one embodiment the present invention may have pile at one face thereof. Such a towel woven fabric might be made up of not less than two layers. Those layers might include gauze layer(s). Such a gauze layer might employ multiple-wound yarn(s). Cotton yarn and lyocell yarn or other such regenerated cellulose yarn manufactured without causing substitution of hydroxy groups might be twisted together as warp yarn and weft yarn in such a multiple-wound yarn. Those layers might further include pile layer(s). A pile surface might be formed on at least an exterior surface of such a pile layer.

A towel woven fabric associated with such an embodiment of the present invention that comprises a gauze layer woven from multiple-wound yarn made up of cotton yarn and lyocell yarn or other such regenerated cellulose yarn manufactured without causing substitution of hydroxy groups may make it possible to carry out satisfactory printing of pictorial content with good coloration on a printable surface at the gauze layer.

BRIEF DESCRIPTION OF DRAWINGS

Many aspects of the invention can be better understood with reference to the following drawings. The components in the drawings are not necessarily to scale, emphasis instead being placed upon clearly illustrating the principles of the present invention.

Moreover, in the drawings, like reference numerals designate corresponding parts throughout the several views.

EMBODIMENTS FOR CARRYING OUT INVENTION

A towel woven fabric suitable for printing of pictorial content, which is associated with an embodiment of the present invention, will be described hereinbelow with reference to the drawings.

In accordance with the present embodiment, lyocell yarn, e.g., Tencel (registered trademark) yarn or other such regenerated fiber, e.g., fiber comprising regenerated cellulose such as regenerated cellulose manufactured by a process not causing substitution of hydroxy groups, is preferably used at the printable surface of the towel woven fabric so as to permit printing to be carried out cleanly and with high resolution using dye-based ink.

A preferred embodiment employs regenerated cellulose fiber manufactured by a process not causing substitution of hydroxy groups. The regenerated cellulose fiber preferably comprises neither rayon nor cuprammonium rayon. The regenerated cellulose fiber is preferably lyocell yarn.

Figure 1:
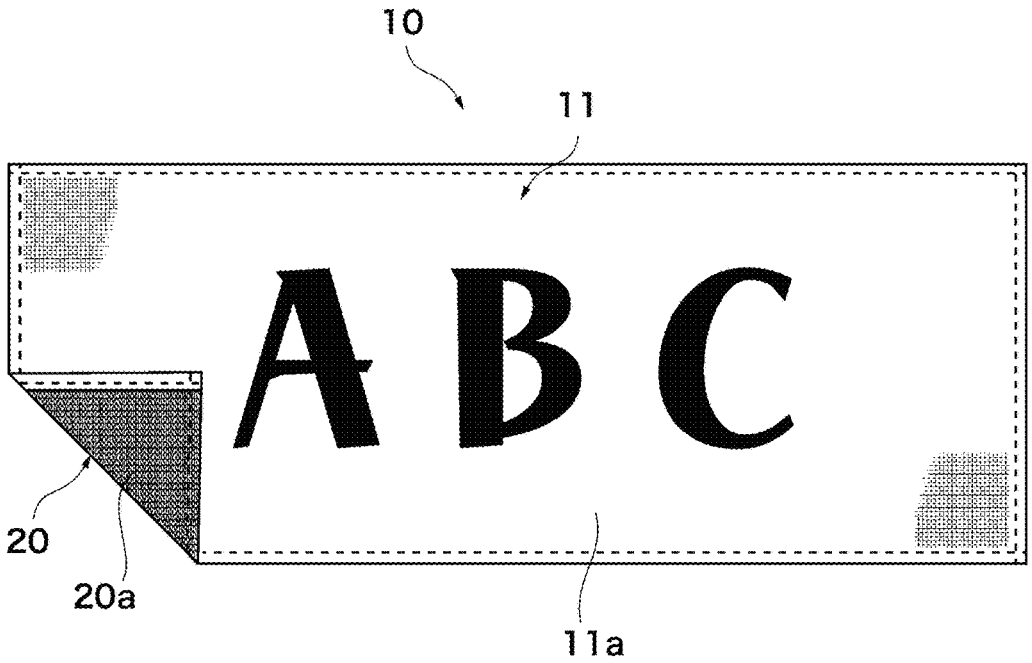
FIG. 1 is a drawing showing the constitution of a towel associated with an embodiment of the present invention.

Towel 10, which is a product that might be manufactured from a towel woven fabric associated with the present embodiment, has a two-layer structure, comprising gauze layer 11, which is a plain weave portion; and pile layer 20, which is a pile-woven portion at which pile is formed on one face thereof. The exterior surface of gauze layer 11 which is the face thereof that is opposite the face that opposes pile layer 20 is printable surface 11*a*, and the exterior surface of pile layer 20 which is the face thereof that is opposite the face that opposes gauze layer 11 is pile surface 20*a* (see FIG. 1).

Gauze layer 11 might be produced by weaving gauze-layer warp yarn 12 and gauze-layer weft yarn 15. Gauze-layer warp yarn 12 and gauze-layer weft yarn 15 are preferably multiple-wound yarns (gauze-layer multiple-wound yarns) in which cotton yarn and lyocell yarn or other such regenerated cellulose yarn manufactured without causing substitution of hydroxy groups are twisted together.

The cotton yarns making up these gauze-layer multiple-wound yarns might be 32-count single-ply yarns, and the lyocell yarns or other such regenerated cellulose yarns manufactured without causing substitution of hydroxy groups making up these gauze-layer multiple-wound yarns might be 40-count two-ply yarns. The mixture ratio of the cotton yarn and the lyocell yarn or other such regenerated cellulose yarn manufactured without causing substitution of hydroxy groups at each of these gauze-layer multiple-wound yarns, expressed as a mass % ratio, might be such that there is 50% lyocell yarn or other such regenerated cellulose yarn manufactured without causing substitution of hydroxy groups with respect to 50% cotton yarn.

It is generally the case that while lyocell yarn or other such regenerated cellulose yarn manufactured without causing substitution of hydroxy groups is superior in terms of coloration with respect to dye-based inks, it has poor strength, and there is even a possibility that breakage will occur if it is placed under high tension during weaving. In accordance with the present embodiment, causing lyocell yarn or other such regenerated cellulose yarn manufactured without causing substitution of hydroxy groups to be included in gauze-layer yarns 12, 15 that make up gauze layer 11 which serves as printable surface 11*a* permits improvement in coloration during printing.

Moreover, by using not lyocell yarn—or other such regenerated cellulose yarn manufactured without causing substitution of hydroxy groups—alone but multiple-wound yarn in which cotton yarn and lyocell yarn or other such regenerated cellulose yarn manufactured without causing substitution of hydroxy groups are twisted together as gauze-layer yarns 12, 15, it is possible to reduce to a minimum the decrease in strength that would otherwise occur due to use of lyocell yarn or other such regenerated cellulose yarn manufactured without causing substitution of hydroxy groups.

While the mixture ratio of the cotton yarn and the lyocell yarn or other such regenerated cellulose yarn manufactured without causing substitution of hydroxy groups at each of the gauze-layer multiple-wound yarns may of course be varied as appropriate, if the mixture ratio of the lyocell yarn or other such regenerated cellulose yarn manufactured without causing substitution of hydroxy groups therein is too high the strength of the gauze-layer multiple-wound yarn will be low, and there is a possibility that breakage will occur due to the tension placed thereon during weaving. Conversely, if the mixture ratio of the lyocell yarn or other such regenerated cellulose yarn manufactured without causing substitution of hydroxy groups therein is too low, this will cause coloration during printing to be poor. It is therefore preferred that the mixture ratio of lyocell yarn or other such regenerated cellulose yarn manufactured without causing substitution of hydroxy groups within the gauze-layer multiple-wound yarn be such that lyocell yarn or other such regenerated cellulose yarn manufactured without causing substitution of hydroxy groups is 30% to 70%, and cotton yarn is 70% to 30%.

Pile layer 20 is produced by weaving pile-layer ground warp yarn 22, pile warp yarn 23, and pile-layer ground weft yarn 25, 30-count single-ply cotton yarns being used as these pile-layer yarns 22, 23, 25. Thus, as the yarns which make up pile layer 20 are all cotton yarns, it has high strength while also permitting maintenance of a soft texture and feel when touched by the hand, in similar fashion as with an ordinary towel.

Figure 2:
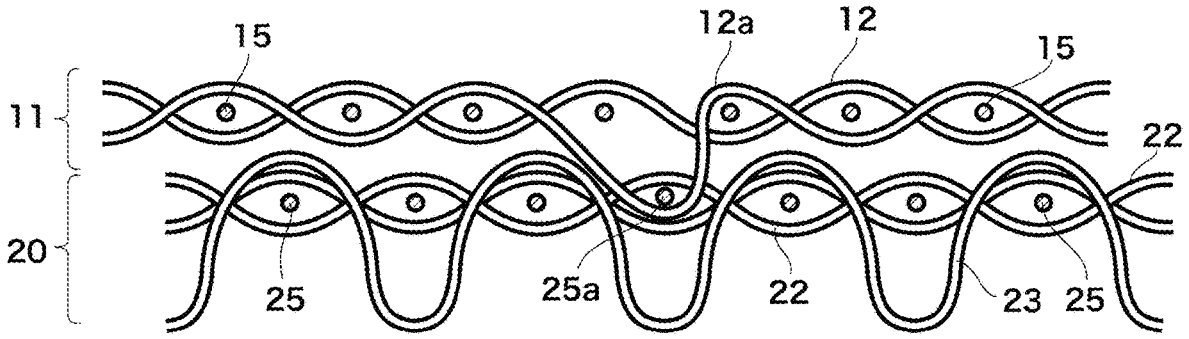
FIG. 2 is a schematic enlarged sectional view of a towel associated with an embodiment of the present invention.

Here, as shown in FIG. 2, gauze layer 11 and pile layer 20 might be coupled by causing gauze-layer warp yarn 12 and pile-layer ground weft yarn 25 to be entangled with prescribed period(s) in the warp direction and in the weft direction. In the present embodiment, pile layer 20, which has pile at one face thereof, is layered with and coupled to gauze layer 11 such that pile surface 20*a*, on which pile is formed, is present at the exterior. At FIG. 2, note that a plurality of weft yarns that are adjacent in the warp direction are for convenience shown as being within the same sectional plane.

Figure 3:
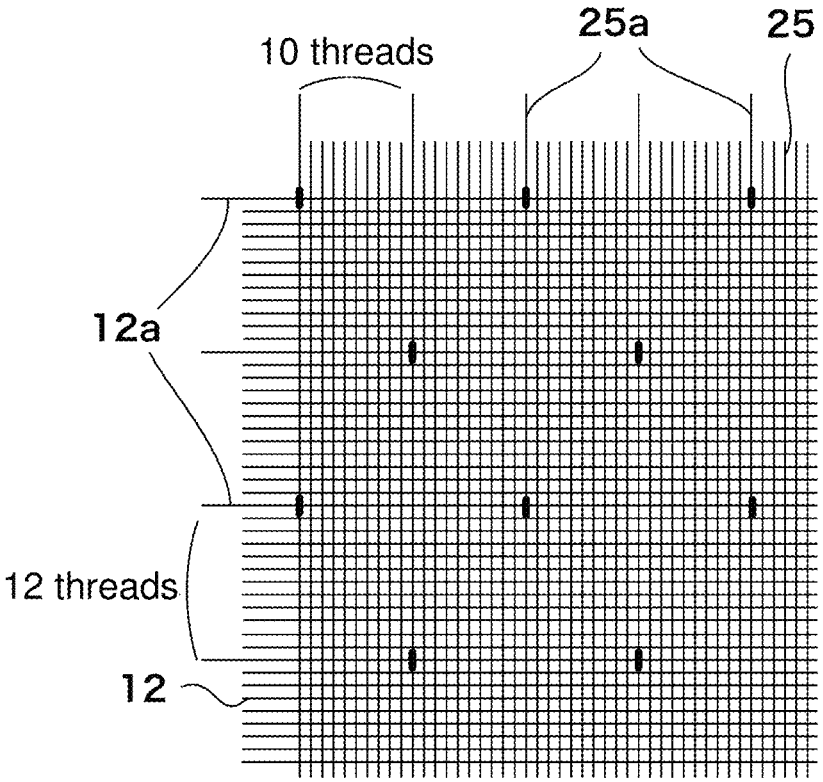
FIG. 3 is a drawing to assist in describing locations at which a gauze layer and a pile layer in a towel associated with an embodiment of the present invention might be coupled.

Regarding the locations at which gauze layer 11 and pile layer 20 are coupled, this occurs with a period of twelve threads in the weft direction; that is, one thread of gauze-layer warp yarn 12 is entangled by pile-layer ground weft yarn 25 for every twelve threads thereof. Coupled pile-layer ground weft yarn 25*a*, which is entangled by one thread of coupled gauze-layer warp yarn 12*a*, has a period of twenty threads in the warp direction; that is, this occurs such that there is one thread of pile-layer ground weft yarn 25*a* for every twenty threads thereof. FIG. 3 is a schematic diagram showing locations at which gauze layer 11 and pile layer 20 might be coupled, pile-layer ground weft yarn 25*a* being shown in thick line at coupled locations.

Here, as shown in FIG. 3, coupled gauze-layer warp yarns 12*a* that are adjacent in the weft direction are such that the locations at which these are coupled with a period of twenty threads to pile-layer ground weft yarns 25*a* are displaced in alternating fashion in the warp direction every ten threads.

Regarding the density in the weft direction of gauze-layer warp yarn 12 at gauze layer 11 and pile-layer ground warp yarn 22 at pile layer 20, the kujira osa count thereof, which indicates the number of warp threads (how many ha there are) per kujira sun (3.7879 cm), is 70-count.

Furthermore, regarding the density in the warp direction of gauze-layer weft yarn 15 at gauze layer 11 and pile-layer ground weft yarn 25 at pile layer 20, the number of threads of weft yarn 15, 25 per inch (2.54 cm) is 110. Furthermore, the mass of towel 10 which has a two-layer structure is 84 g. In accordance with the present embodiment, weave density is made to be somewhat high so as to make it possible for printing to be carried out with high resolution.

The constitution of towel 10 having been described in detail above, the present embodiment comprises gauze layer 11 woven from multiple-wound yarn made up of lyocell yarn or other such regenerated cellulose yarn manufactured without causing substitution of hydroxy groups and cotton yarn, and makes it possible to achieve good coloration when using dye-based ink to carry out printing of pictorial content on printable surface 11*a* at the exterior of gauze layer 11.

Furthermore, towel 10 comprises pile layer 20, at the exterior of which pile surface 20*a* is located, making it possible to maintain a soft feel against the skin and texture as befits a towel woven fabric while also permitting satisfactory printing.

Furthermore, in accordance with the present embodiment, by causing the cotton yarns in the gauze-layer multiple-wound yarns to be single-ply yarns, and causing the lyocell yarns or other such regenerated cellulose yarns manufactured without causing substitution of hydroxy groups in the gauze-layer multiple-wound yarns to be two-ply yarns, this makes it possible to increase the area of lyocell yarn or other such regenerated cellulose yarn manufactured without causing substitution of hydroxy groups as compared with cotton yarn at the surface of printable surface 11*a* at gauze layer 11, and makes it possible to achieve satisfactory printing using dye-based ink.

Furthermore, with respect to the multiple-wound yarns, because it is generally the case that increasing the number of yarn plies that are twisted together will increase yarn surface unevenness and reduce printing resolution, it is preferred for satisfactory printing that few yarn plies be twisted together therein. In accordance with the present embodiment, by causing cotton yarn for reinforcing strength to be single-ply yarn, and causing lyocell yarn or other such regenerated cellulose yarn manufactured without causing substitution of hydroxy groups to be two-ply yarn, this makes it possible to achieve satisfactory printing while also maintaining the strength of the multiple-wound yarns which comprise cotton yarn and lyocell yarn or other such regenerated cellulose yarn manufactured without causing substitution of hydroxy groups.

Moreover, the present invention is not limited to the foregoing embodiment but admits of any number of variations without departing from the gist of the present invention. For example, the shapes, sizes, materials and so forth of the members that make up the towel associated with the present embodiment may be varied as appropriate.

Furthermore, so long as it can be done while ensuring some degree of soft feel against the skin and texture, the pile layer may be made up not of cotton yarn but of yarn made of polyester or other such different material(s). Furthermore, whereas at the foregoing embodiment the pile layer had pile at one face thereof, it is possible to employ a pile layer that has pile at both faces thereof.

Furthermore, whereas at the foregoing embodiment the towel had a two-layer structure in which there was a gauze layer and a pile layer, so long as it can be done while providing a printable surface in the form of a gauze layer comprising multiple-wound yarn(s) made up of cotton yarn(s) and lyocell yarn(s) or other such regenerated cellulose yarn(s) manufactured without causing substitution of hydroxy groups, the structure thereof may be such that there are three or more layers.

Furthermore, it goes without saying that printing on the printable surface need not be printing using dye-based ink but may be printing using pigment-based ink or printing by some other different method.

EXPLANATION OF REFERENCE NUMERALS

10 Towel
11 Gauze layer
11*a* Printable surface
12 Gauze-layer warp yarn
12*a* Coupled gauze-layer warp yarn
15 Gauze-layer weft yarn
20 Pile layer
20*a* Pile surface
22 Pile-layer ground warp yarn
23 Pile warp yarn (cotton yarn)
25 Pile-layer ground weft yarn
25*a* Coupled pile-layer ground weft yarn

What is claimed is:

1. A towel woven fabric having pile at one face thereof and made up of not less than two layers, the towel woven fabric comprising:

a gauze layer comprising a gauze layer warp yarn and a gauze layer weft yarn, the gauze layer warp yarn employing a first multiple-wound yarn in which a first cotton yarn and a first regenerated cellulose yarn that has been manufactured without causing substitution of hydroxy groups are twisted together, and the gauze layer weft yarn employing a second multiple-wound yarn in which a second cotton yarn and a second regenerated cellulose yarn that has been manufactured without causing substitution of hydroxy groups are twisted together; and a pile layer at which a pile surface is formed on at least an exterior surface thereof.

2. The towel woven fabric according to claim 1 wherein the pile layer comprises woven pile layer cotton yarn.

3. The towel woven fabric according to claim 1 wherein the gauze layer and the pile layer are coupled such that entanglement of the gauze layer warp yarn and a ground weft yarn of the pile layer occurs with a prescribed period.

4. The towel woven fabric according to claim 1 wherein the first and second cotton yarns are single-ply yarns, and the first and second regenerated cellulose yarns are two-ply yarns.

5. The towel woven fabric according to claim 4 wherein the combined content of the first and second cotton yarns in the first and second multiple-wound yarns is 30 mass % to 70 mass %, and the combined content of the first and second regenerated cellulose yarns in the first and second multiple-wound yarns is 70 mass % to 30 mass %.

6. The towel woven fabric according to claim 2 wherein the first and second cotton yarns are single-ply yarns, and the first and second regenerated cellulose yarns are two-ply yarns.

7. The towel woven fabric according to claim 6 wherein the combined content of the first and second cotton yarns in the first and second multiple-wound yarns is 30 mass % to 70 mass %, and the combined content of the first and second regenerated cellulose yarns in the first and second multiple-wound yarns is 70 mass % to 30 mass %.

8. The towel woven fabric according to claim 3 wherein the first and second cotton yarns are single-ply yarns, and the first and second regenerated cellulose yarns are two-ply yarns.

9. The towel woven fabric according to claim 8 wherein the combined content of the first and second cotton yarns in the first and second multiple-wound yarns is 30 mass % to 70 mass %, and the combined content of the first and second regenerated cellulose yarns in the first and second multiple-wound yarns is 70 mass % to 30 mass %.

10. The towel woven fabric according to claim 1 wherein the first and second regenerated cellulose yarns comprise neither rayon nor cuprammonium rayon.

11. The towel woven fabric according to claim 10 wherein the first and second regenerated cellulose yarns are lyocell yarns.

* * * * *